US008218998B2

(12) United States Patent
Koido

(10) Patent No.: US 8,218,998 B2
(45) Date of Patent: Jul. 10, 2012

(54) DEVELOPER STORING CONTAINER HAVING A SEAL TO PREVENT TONER LEAKAGE

(75) Inventor: Shigenori Koido, Tokyo (JP)

(73) Assignee: Oki Data Corporation, Tokyo (JP)

( * ) Notice: Subject to any disclaimer, the term of this patent is extended or adjusted under 35 U.S.C. 154(b) by 353 days.

(21) Appl. No.: 12/588,937

(22) Filed: Nov. 3, 2009

(65) Prior Publication Data

US 2010/0111571 A1 May 6, 2010

(30) Foreign Application Priority Data

Nov. 4, 2008 (JP) ..... 2008-282973

(51) Int. Cl.
*G03G 15/08* (2006.01)
*G03G 15/04* (2006.01)

(52) U.S. Cl. ..... 399/103; 399/119; 399/254

(58) Field of Classification Search ..... 399/103, 399/105, 106, 119, 120, 254
See application file for complete search history.

(56) References Cited

U.S. PATENT DOCUMENTS

| | | | | |
|---|---|---|---|---|
| 5,166,731 | A * | 11/1992 | Aimoto et al. | 399/103 |
| 5,848,342 | A * | 12/1998 | Tanda | 399/358 |
| 2004/0190929 | A1 * | 9/2004 | Yoshiki | 399/103 |

FOREIGN PATENT DOCUMENTS

| | | |
|---|---|---|
| JP | 2-111980 | 4/1990 |
| JP | 2004-21062 | 1/2004 |
| JP | 2004-70245 | 3/2004 |
| JP | 2005-292366 | 10/2005 |
| JP | 2006-243466 A | 9/2006 |
| JP | 2008-26728 | 2/2008 |

* cited by examiner

*Primary Examiner* — David Gray
*Assistant Examiner* — Joseph S Wong
(74) *Attorney, Agent, or Firm* — Rabin & Berdo, P.C.

(57) ABSTRACT

A developer storing container includes a developer storing chamber storing a developer therein and having a side wall, and an agitating member having a shaft portion rotatably supported by the side wall. The side wall has a hollow portion surrounding the shaft portion of the agitating member. A seal member having an annular shape is provided between the hollow portion and the shaft portion. The seal member has an outer circumferential surface contacting the hollow portion, and an inner circumferential surface contacting the shaft portion. A contact pressure between the outer circumferential surface of the seal member and the hollow portion is larger than a contact pressure between the inner circumferential surface of the seal member and the shaft portion of the agitating member.

19 Claims, 7 Drawing Sheets

DEVELOPER STORING CONTAINER HAVING A SEAL TO PREVENT TONER LEAKAGE

BACKGROUND OF THE INVENTION

The present invention relates to a developer storing container that stores a developer, and a developing device and an image forming apparatus.

Conventionally, a toner cartridge is detachably mounted to a developing unit, and includes an outer cartridge in which a toner storing chamber for storing a toner is provided. An agitating member is rotatably provided in the outer cartridge for agitating the toner stored in the toner storing chamber. The agitating member is rotatably supported by a shaft-receiving portion mounted to a side wall of the outer cartridge (see, for example, Patent Publication No. 1).

Patent Publication No. 1: Japanese Laid-Open Patent Publication No. 2006-243466 (see, Page 4, FIG. 3)

In this regard, there is a demand to ensure the prevention of leakage of the toner to the outside of the toner storing chamber.

SUMMARY OF THE INVENTION

The present invention is intended to provide a developer storing container, a developing device and an image forming apparatus capable of preventing leakage of developer from a developer storing chamber.

The present invention provides a developer storing container including a developer storing chamber storing a developer therein and having a side wall, and an agitating member having a shaft portion rotatably supported by the side wall. The side wall has a hollow portion surrounding the shaft portion of the agitating member. A seal member having an annular shape is provided between the hollow portion and the shaft portion. The seal member has an outer circumferential surface contacting the hollow portion, and an inner circumferential surface contacting the shaft portion. A contact pressure between the outer circumferential surface of the seal member and the hollow portion is larger than a contact pressure between the inner circumferential surface of the seal member and the shaft portion of the agitating member.

With such a configuration, the leakage of the developer from the developer storing chamber can be prevented by the contact between the outer circumferential surface of the seal member and the hollow portion.

The present invention also provides a developer storing container including a developer storing chamber storing a developer therein and having a side wall, and an agitating member having a shaft portion rotatably supported by the side wall. The side wall has a hollow portion surrounding the shaft portion of the agitating member. A seal member having an annular shape is mounted between the hollow portion and the shaft portion. The agitating member has a side-contact portion disposed adjacent to the seal member, and the side-contact portion has an outer diameter which is larger than an inner diameter of the seal member. The seal member has an outer circumferential surface contacting the hollow portion of the side wall, and has a side surface contacting the side-contact portion of the agitating member.

With such a configuration, the leakage of the developer from the developer storing chamber can be prevented by the contact between the side surface of the seal member and the side-contact portion of the agitating member.

The present invention also provides a developing device including the above described developer storing container.

The present invention also provides an image forming apparatus including the above described developing device.

Further scope of applicability of the present invention will become apparent from the detailed description given hereinafter. However, it should be understood that the detailed description and specific embodiments, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

First Embodiment

Figure 1:
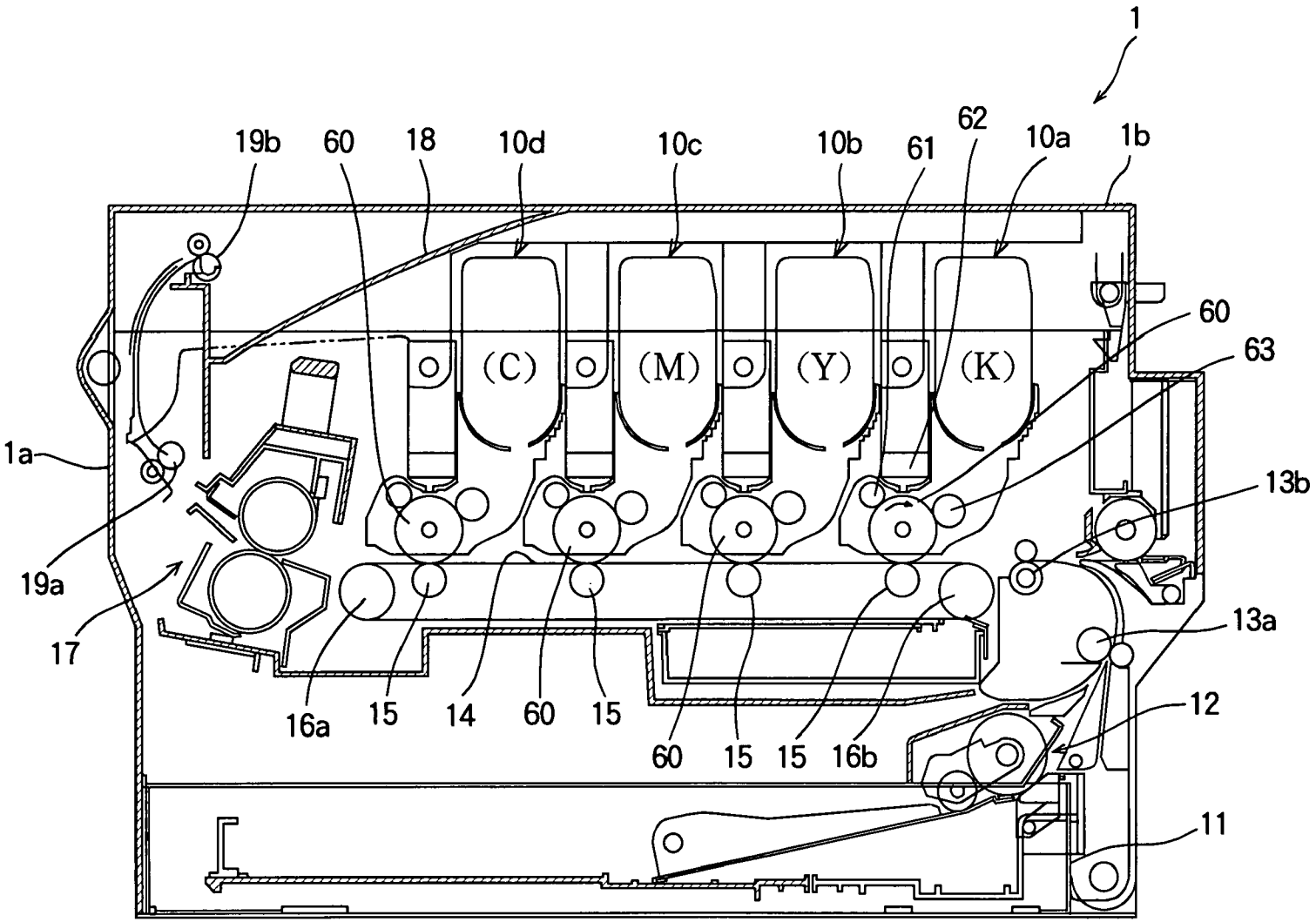
FIG. 1 is a sectional view showing an entire configuration of an image forming apparatus according to the first embodiment of the present invention.

FIG. 1 is a sectional view showing an entire configuration of an image forming apparatus according to the first embodiment of the present invention. Hereinafter, an image forming apparatus (for example, a color printer) capable of forming a color image will be described.

In FIG. 1, the image forming apparatus 1 has a main body including a lower cover 1*a* and an upper cover 1*b*. Image forming units 10*a*, 10*b*, 10*c* and 10*d* are disposed in the main body of the image forming apparatus 1. The image forming units 10*a*, 10*b*, 10*c* and 10*d* are disposed along a feeding path of a medium (here, from the left to the right in FIG. 1) and respectively form toner images of four colors of K (black), Y (Yellow), M (magenta) and C (Cyan).

A medium tray 11 for storing the media (for example, papers) is mounted to a lower part of the main body of the image forming apparatus 1. A sheet supply roller 12 is provided on the right side (in FIG. 1) of the medium tray 11. The sheet supply roller 12 individually feeds the medium one by one out of the medium tray 11. Two feeding roller pairs 13*a* and 13*b* are disposed on the upper side (in FIG. 1) of the sheet supply roller 12. The feeding roller pairs 13*a* and 13*b* feed the medium to the image forming units 10*a*, 10*b*, 10*c* and 10*d*. Further, a transfer belt 14 (also referred to as a conveying belt) is disposed below the image forming units 10*a*, 10*b*, 10*c* and 10*d*. The transfer belt 14 feeds the medium through the image forming units 10*a*, 10*b*, 10*c* and 10*d* so as to transfer toner images of respective colors to the medium.

The image forming units 10*a*, 10*b*, 10*c* and 10*d* include photosensitive drums 60 as latent image bearing bodies. Configurations of the image forming units 10*a*, 10*b*, 10*c* and 10*d* will be described later.

Four transfer rollers 15 are disposed facing the respective photosensitive drums 60 of the image forming units 10*a*, 10*b*, 10*c* and 10*d* so that the transfer belt 14 is sandwiched between the transfer rollers 15 and the photosensitive drums 60. The transfer belt 14 is stretched around a driving roller 16*a* and a driven roller 16*b* disposed on both sides of the transfer rollers 15 in an arranging direction of the transfer rollers 15. The driving roller 16*a* rotates so as to move the transfer belt 14. The transfer rollers 15 are applied with bias voltages for transferring the toner images on the surfaces of the respective photosensitive drums 60 to the medium held on the transfer belt 14.

A fixing unit 17 is disposed on the downstream side (i.e., the left side in FIG. 1) of the image forming units 10*a*, 10*b*, 10*c* and 10*d* in the sheet feeding direction. The fixing unit 17 applies heat and pressure to the toner image so as to fix the toner image to the medium. Further, two ejection roller pairs 19*a* and 19*b* are disposed on the downstream side of the fixing unit 17. The ejection roller pairs 19*a* and 19*b* eject the medium (on which the toner image is fixed) to a stacker portion 18 on the upper cover 1*b*.

Figure 2:
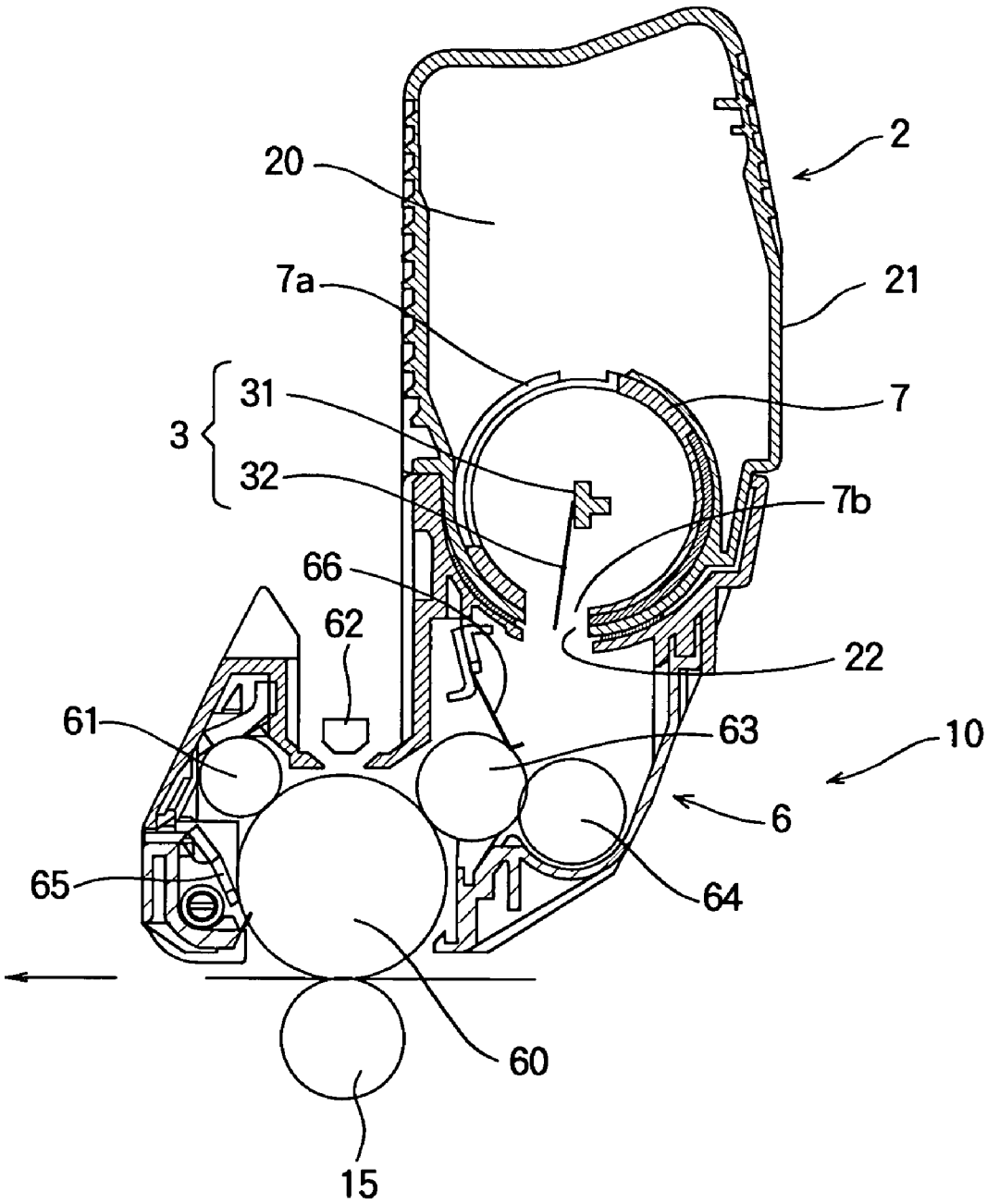
FIG. 2 is a sectional view showing a common internal structure of image forming units according to the first embodiment of the present invention.

FIG. 2 is a sectional view showing a common internal configuration of the image forming units 10*a*, 10*b*, 10*c* and 10*d*. The image forming units 10*a*, 10*b*, 10*c* and 10*d* have a common configuration except the kinds of the toners, and therefore the common configuration will be described as "image forming unit 10".

The image forming unit 10 includes a toner cartridge 2 as a developer storing container, and an image drum unit 6 to which the toner cartridge 2 is detachably mounted. The toner cartridge 2 includes an outer cartridge 21 as a casing which is elongated in one direction (parallel to an axial direction of the photosensitive drum 60). A toner storing chamber 20 (i.e., a developer storing chamber, or a first storing chamber) for storing a toner (i.e., a developer) is provided in the outer cartridge 21. A toner supply opening 22 is formed on the bottom of the outer cartridge 21 through which the toner in the toner storing container 20 is supplied to the image drum unit 6.

A shutter 7 is provided inside the outer cartridge 21 for opening and closing the toner supply opening 22. The shutter 7 has a substantially cylindrical shape with a center axis parallel to the longitudinal direction of the outer cartridge 21. An upper part of the shutter 7 includes a widely opened area. An opening 7*b* is formed on a lower part of the shutter 7, and the opening 7*b* has a shape corresponding to the toner supply opening 22. The shutter 7 is rotatably supported in the outer cartridge 21. When the opening 7*b* is aligned with the toner supply opening 22, the toner in the toner storing chamber 20 is supplied to the image drum unit 6.

The image drum unit 6 includes the above described photosensitive drum 60 that rotates in one direction (clockwise in FIG. 2). Along a circumference of the photosensitive drum 60, a charging roller 61, an LED head 62 (mounted to the upper cover 1*b*), a developing roller 63, the above described transfer roller 15 (mounted to the lower cover 1*a*) and a cleaning blade 65 are disposed in this order in the rotating direction of the photosensitive drum 60. The charging roller 61 uniformly charges the surface of the photosensitive drum 60. The LED head 62 as an exposure device exposes the surface of the photosensitive drum 60 to form a latent image. The developing roller 63 develops the latent image on the surface of the photosensitive drum 60 to form a toner image. The transfer roller 15 transfers the toner image from the surface of the photosensitive drum 60 to the medium. The cleaning blade 65 removes the residual toner on the surface of the photosensitive drum 60. Further, a supply roller 64 and a developing blade 66 are disposed contacting the developing roller 63. The supply roller 64 supplies the toner to the developing roller 63. The developing blade 66 regulates a thickness of the toner layer formed on the surface of the developing roller 63. The developing roller 63 and the supply roller 64 are disposed below the toner supply opening 22 of the above described toner cartridge 2.

In this regard, components functioning to develop the latent image (in this example, the developing roller 63, the supply roller 64, the developing blade 66 and the toner cartage 2) constitute a developing device.

An operation of the image forming apparatus 1 will be described.

First, the sheet supply roller 12 feeds the medium out of the medium tray 11. The medium fed out of the medium tray 11 is further fed by the feeding roller pairs 13*a* and 13*b* to the transfer belt 14. The transfer belt 14 feeds the medium through the image forming units 10*a*, 10*b*, 10*c* and 10*d*. In the respective image forming units 10*a*, 10*b*, 10*c* and 10*d*, the LED heads 62 expose the surfaces of the photosensitive drums 60 according to image information to form latent images, and the developing rollers 63 develop the latent images with toners of respective colors. The toner images formed on the photosensitive drums 60 of the image forming units 10*a*, 10*b*, 10*c* and 10*d* are transferred to the medium fed by the transfer belt 14. The medium to which the toner image is transferred is fed to the fixing unit 17. The fixing unit 17 applies heat and pressure to the toner image so as to fix the toner image to the medium. The medium to which the toner image is fixed is ejected by the ejection roller pairs 19*a* and 19*b* to the stacker portion 18.

Figure 3:
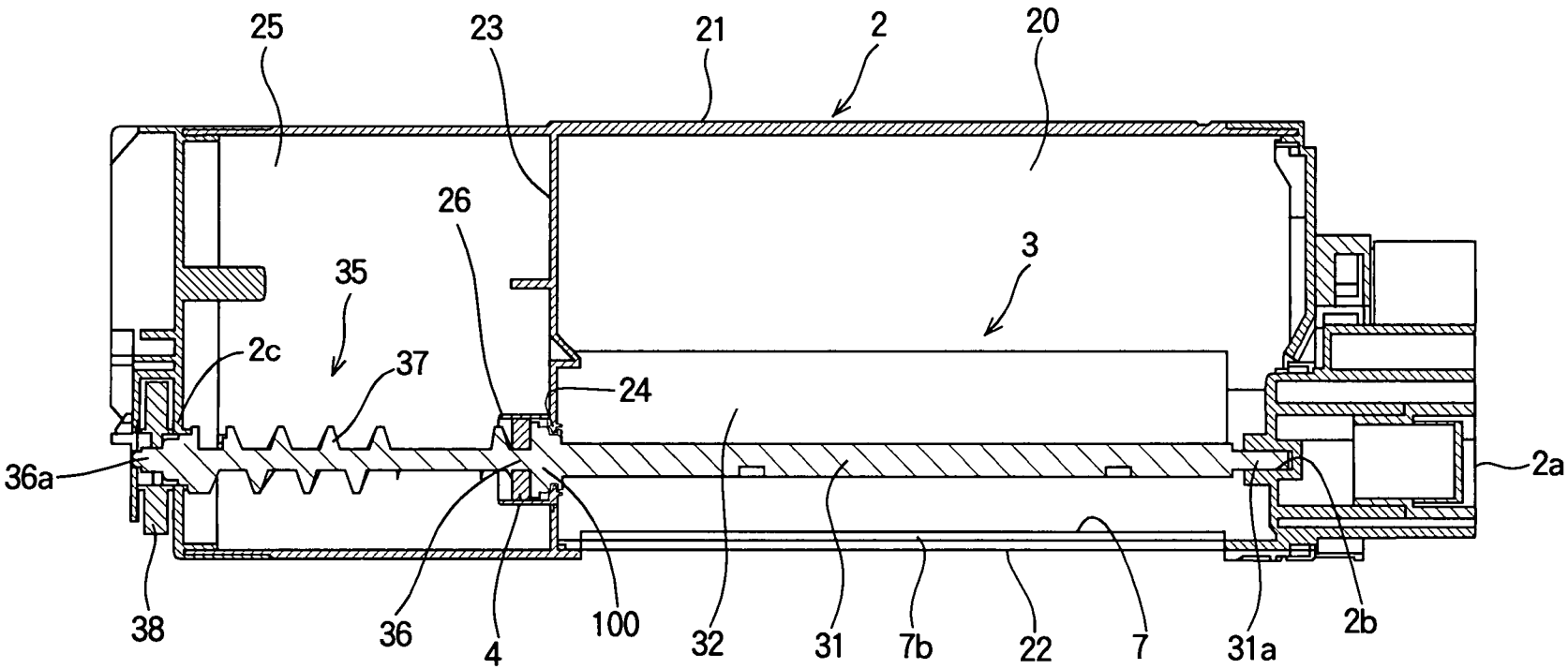
FIG. 3 is a longitudinal sectional view showing a toner cartridge according to the first embodiment of the present invention.
Figure 4:
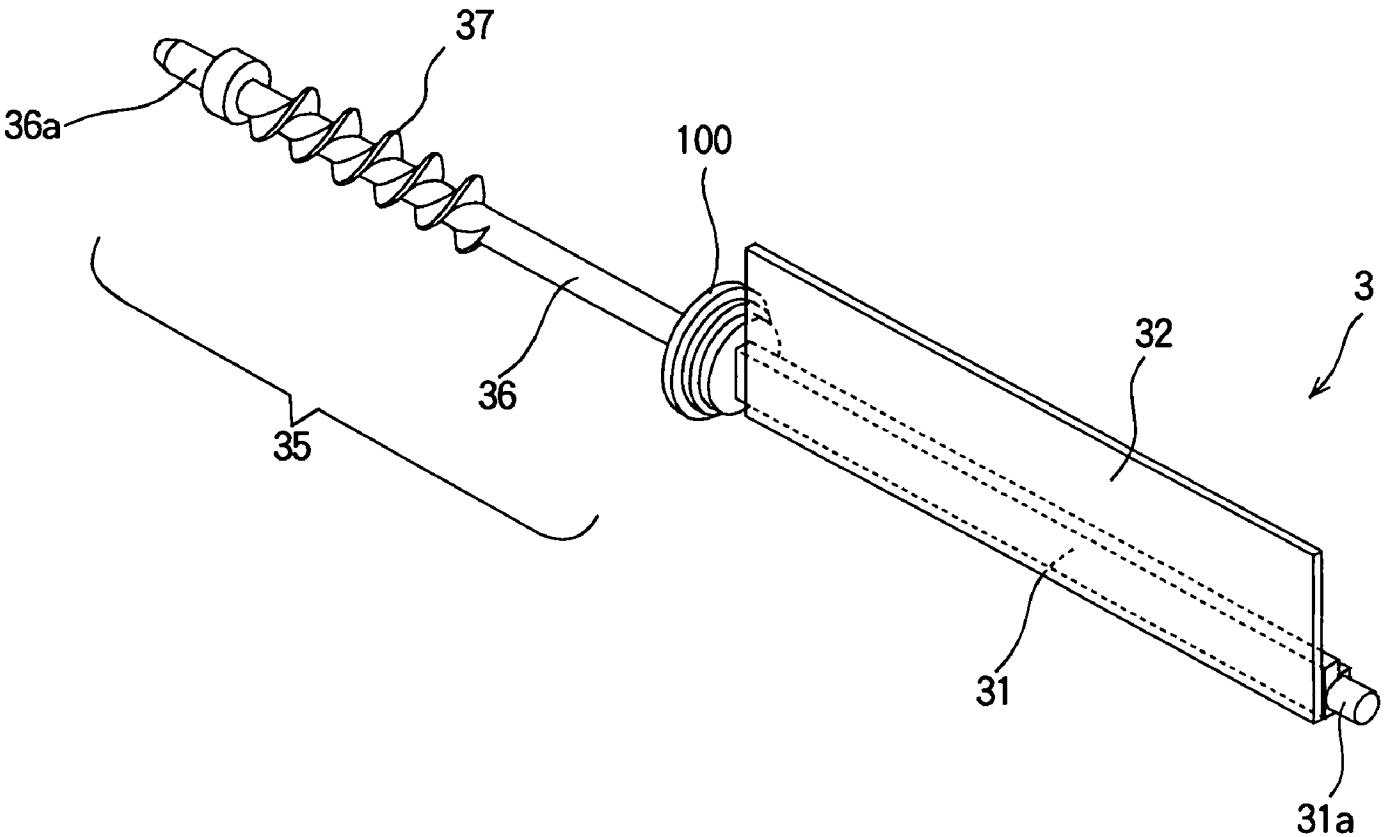
FIG. 4 is a perspective view schematically showing a shape of an agitating bar provided in the toner cartridge according to the first embodiment of the present invention.

Next, a configuration of the toner cartridge 2 will be described in detail. FIG. 3 is a longitudinal sectional view of the toner cartridge 2. FIG. 4 is a perspective view schematically showing a shape of an agitating bar 3 provided in the toner cartridge 2.

As shown in FIG. 3, the toner cartridge 2 includes a toner storing chamber 20 and a waste toner storing chamber 25 (i.e., a second storing chamber) which are adjacent to each other in the longitudinal direction of the toner cartridge 2 via a side wall (i.e., a partition wall) 23.

The agitating bar 3 (i.e., an agitating member) is disposed in the toner storing chamber 20 for agitating the toner. The agitating bar 3 includes a shaft portion 31 extending in the longitudinal direction of the outer cartridge 21 and having a substantially T-shaped cross section. A blade portion 32 is fixed to the shaft portion 31. The blade portion 32 is in the form of a sheet or thin-plate. The agitating bar 3 is rotatably supported by a shaft-receiving portion (i.e., a shaft-receiving hole) 24 formed on the side wall 23. By the rotation of the agitating bar 3, the toner in the toner storing chamber 20 is supplied to the image drum unit 6 via the opening 7*b* and the toner supply opening 22.

As shown in FIG. 4, a larger-diameter portion 100 is coaxially formed on an end of the shaft portion 31 having the substantially T-shaped cross section. Further, a shaft portion 36 having a circular cross section is formed on a side opposite to the shaft portion 31 with respect to the larger-diameter portion 100. The shaft portion 36 is coaxial with the shaft portion 31 and the larger-diameter portion 100. A spiral portion 37 is formed around the shaft portion 36. The shaft portion 36 and the spiral portion 37 constitute a screw conveyor portion 35 for conveying a waste toner. By the rotation of the screw conveyor portion 35, the waste toner received from a waste toner receiving opening (not shown) on the left end (in FIG. 3) of the waste toner storing chamber 25 is conveyed to the inside of the waste toner storing chamber 25.

As shown in FIG. 3, an end portion 31*a* of the shaft portion 31 opposite to the larger-diameter portion 100 rotatably engages a hole portion 2*b* formed on a lid 2*a* provided on an end of the outer cartridge 2 in the longitudinal direction (i.e., a right end of the outer cartridge 2 in FIG. 3). An end portion 36*a* (and its vicinity) of the shaft portion 36 opposite to the larger-diameter portion 100 rotatably engages a hole portion 2*c* formed on a wall provided on the other end of the outer cartridge 2 in the longitudinal direction (i.e., a left end of the outer cartridge 2 in FIG. 3). Further, a gear 38 is fixed to the end portion 36*a*, which receives a power transmitted from an external driving source (not shown).

The agitating bar 3 is rotated by the rotation of the gear 38 fixed to the shaft portion 36. The blade portion 32 of the agitating bar 3 agitates the toner in the toner storing chamber 20 so as to supply the toner to the image drum unit 6 via the opening 7*b* and toner supply opening 22. Further, the waste toner supplied into the waste toner storing chamber 25 via the waste toner receiving opening (not shown) falls on the screw conveyor portion 35 of the agitating bar 3, and the waste toner is conveyed in the direction toward the side wall 23 by the motion of the spiral portion 37.

The toner, which has been scraped off by the cleaning blade 65 (FIG. 2) of the image drum unit 6, is collected by a waste toner collecting portion (not shown), conveyed by a waste toner conveying portion, and is supplied into the waste toner storing chamber 25 via the waste toner receiving opening of the waste toner storing chamber 25. The detailed explanation thereof will be omitted.

The agitating bar 3 is required to have mechanical strength to some extent, and therefore the agitating bar 3 is preferably formed of ABS (Acrylonitrile Butadiene Styrene) resin. It is more preferable that the agitating bar 3 is formed of ABS resin having high rigidity reinforced by glass fiber. In this example, the spiral portion 37 of the screw conveyer portion 35 of the agitating bar 3 is formed so as to extend from the left end portion (in FIG. 3) of the waste toner storing chamber to substantially halfway in the waste toner storing chamber 25, and is also formed in the vicinity of the side wall 23.

A cylindrical portion (i.e., a tubular portion) 26 as a hollow or surrounding portion is formed on the side wall 23 of the toner cartridge 2. The cylindrical portion 26 is coaxial with the above described shaft-receiving portion 24, and protrudes into the waste toner storing chamber 25. The cylindrical portion 26 has an inner diameter larger than an outer diameter of the larger-diameter portion 100 of the agitating bar 3, and surrounds the larger-diameter portion 100. A seal sponge 4 (i.e., a seal member) is provided inside the cylindrical portion 26 so as to surround the shaft portion 36 of the agitating bar 3. The seal sponge 4 has an annular shape, and is formed of urethane foam. It is preferable that a position of the seal sponge 4 in the axial direction is regulated by the spiral portion 37 formed on the shaft portion 36.

Figure 5A:
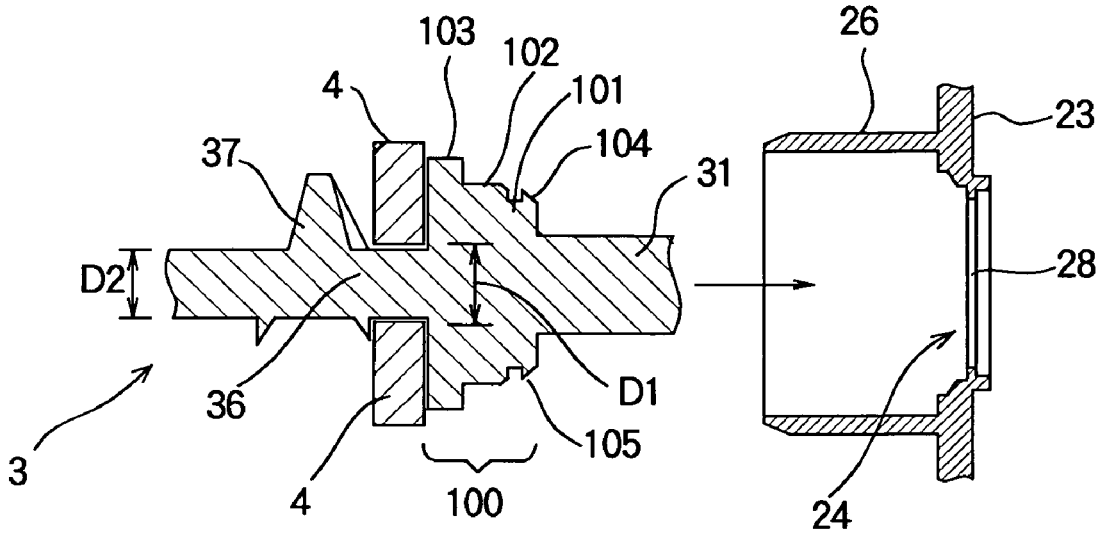
FIG. 5A is an enlarged view showing the agitating bar and a side wall before assembling of the toner cartridge according to the first embodiment of the present invention.
Figure 5B:
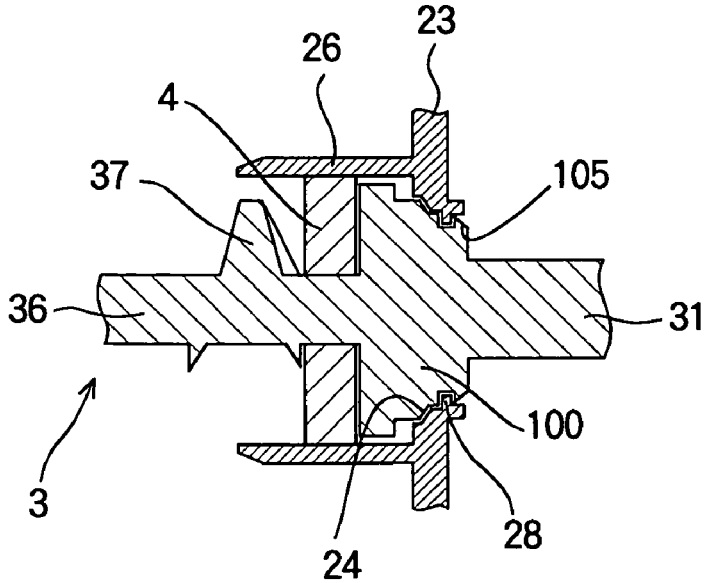
FIG. 5B is an enlarged view showing the agitating bar and the side wall after the assembling of the toner cartridge according to the first embodiment of the present invention.

FIGS. 5A and 5B are enlarged views showing the relationship between the agitating bar 3 and the side wall 23 respectively before and after the assembling of the toner cartridge 2.

The seal sponge 4 has an outer diameter which is larger than an inner diameter of the cylindrical portion 26 of the side wall 23. When the seal sponge 4 is inserted into the cylindrical portion 26, the seal sponge 4 is resiliently compressed, so that an outer circumferential surface of the seal sponge 4 is pressed against the inner circumferential surface of the cylindrical portion 26. The seal sponge 4 has an inner diameter D1 which is larger than the outer diameter D2 of the shaft portion 36. In this regard, it is preferable that the following relationship is satisfied:

$$D1 \geqq D2+0.8 \text{ (mm)}$$

The larger-diameter portion 100 includes a first portion 101, a second portion 102 and a third portion 103 in this order from the side wall 23 side to the waste toner storing chamber 25 side (from the right to the left in FIG. 5A). The first portion 101, the second portion 102 and the third portion 103 are coaxial with each other. The first portion 101 engages the shaft-receiving portion 24. The second portion 102 has a larger outer diameter than the first portion 101. The third portion 103 has a larger outer diameter than the second portion 102. The outer diameter of the third portion 103 is smaller than the inner diameter of the cylindrical portion 26. Further, the outer diameter of the third portion 103 is larger than the inner diameter D1 of the seal sponge 4 (and also larger than the outer diameter of the shaft portion 36), and is smaller than the outer diameter of the seal sponge 4.

A tapered surface 104 is formed on an insertion-side end (i.e., a right end in FIG. 5A) of the outer circumferential surface of the first portion 101 of the larger-diameter portion 100. A claw portion 105 is formed on a border between the tapered surface 104 and the outer circumferential surface of the first portion 101. The claw portion 105 (i.e., an engaging portion) extends in an extending direction of the tapered surface 104. In this regard, the claw portion 105 is omitted in the schematic perspective view of FIG. 4.

When the larger-diameter portion 100 is inserted into the shaft-receiving portion 24, the claw portion 105 moves beyond a convex portion 28 annularly formed on the inner circumferential surface of the shaft-receiving portion 24 as shown in FIG. 5B, and the claw portion 105 engages a right side (in FIG. 5B) of the shaft-receiving portion 24 (i.e., the toner storing chamber 20 side of the shaft-receiving portion 24). With the engagement between the claw portion 105 and the shaft-receiving portion 24, the larger-diameter portion 100 and the shaft-receiving portion 24 engage each other, and the agitating bar 3 is rotatably supported by the shaft-receiving portion 24.

In this state, the seal sponge 4 is also inserted into the cylindrical portion 26. As the seal sponge 4 is inserted into the cylindrical portion 26, the seal sponge 4 is resiliently compressed, and the outer circumferential surface of the seal sponge 4 is pressed against the inner circumferential surface of the cylindrical portion 26, so as to seal between the seal sponge 4 and the cylindrical portion 26. Further, as the seal sponge 4 is compressed from the outer side, the inner circumferential surface of the seal sponge 4 is pressed against the outer circumferential surface of the shaft portion 36, so as to seal between the seal sponge 4 and the shaft portion 36. A compression amount of the seal sponge 4 caused by being pressed against the shaft portion 36 is smaller than a compression amount of the seal sponge 4 caused by being pressed against the cylindrical portion 26. In other words, a contact pressure between the seal sponge 4 and the shaft portion 36 is smaller than a contact pressure between the seal sponge 4 and the cylindrical portion 26.

With the above configured toner cartridge 2, even if the toner in the toner storing chamber 20 passes through between the shaft-receiving portion 24 and the larger-diameter portion 100 due to various kinds of vibration during transportation, a further movement of the toner is prevented since the outer circumferential surface of the seal sponge 4 is pressed against the inner circumferential surface of the cylindrical portion 26, and since the inner circumferential surface of the seal sponge 4 is pressed against the shaft portion 36 of the agitating bar 3. As a result, the leakage of the toner from the toner storing chamber 20 can be prevented.

Further, since the contact pressure between the seal sponge 4 and the shaft portion 36 is smaller than the contact pressure between the seal sponge 4 and the cylindrical portion 26, the seal sponge 4 does not rotate relative to the cylindrical portion 26, but the shaft portion 36 rotates relative to the seal sponge 4 when the agitating bar 3 rotates in the printing operation for supplying the toner to the image drum unit 6. In other words, the seal sponge 4 does not follow the rotation of the shaft portion 36. Thus, the outer circumferential surface of the seal sponge 4 does not make a sliding contact with the inner circumferential surface of the cylindrical portion 26. Therefore, it is further ensured that the leakage of the toner through between the outer circumferential surface of the seal sponge 4 and the inner circumferential surface of the cylindrical portion 26 is prevented.

Moreover, since the third portion 103 (i.e., a portion closest to the seal sponge 4) of the larger-diameter portion 100 has the outer diameter larger than the inner diameter D1 of the seal sponge 4, the third portion 103 prevents the toner from entering into the toner storing chamber 20 even if the toner moves toward the toner strong chamber 20 leaking through between the shaft portion 36 and the inner circumferential surface of the seal sponge 4.

Furthermore, the larger-diameter portion 100 has a shape with the outer diameter increasing in the direction toward the seal sponge 4. With such a shape, even if the toner may pass through between the shaft-receiving portion 24 and the larger-diameter portion 100, a further movement of the toner is prevented by a contact portion between the outer circumferential surface of the seal sponge 4 and the inner circumferential surface of the cylindrical portion 26 (i.e., a contact portion where the seal sponge 4 and the cylindrical portion 26 contact each other at a larger contact pressure). Therefore, it is further ensured that the leakage of the toner is prevented.

As described above, according to the first embodiment of the present invention, the outer circumferential surface of the seal sponge 4 contacts the inner circumferential surface of the cylindrical portion 26, and the inner circumferential surface of the seal sponge 4 contacts the shaft portion 36 of the agitating bar 3. Therefore, the movement of the toner is prevented by these contact portions. Since the toner is prevented from passing through the gap between the seal sponge 4 and the cylindrical portion 26 and the gap between the seal sponge 4 and the shaft portion 36, the leakage of the toner is prevented even when the toner cartridge 2 is applied with vibration during transportation.

Particularly, the contact pressure between the seal sponge 4 and the shaft portion 36 is smaller than the contact pressure between the seal sponge 4 and the cylindrical portion 26, and therefore the seal sponge 4 does not rotate relative to the cylindrical portion 26, but the shaft portion 36 rotates relative to the seal sponge 4. Therefore, the outer circumferential surface of the seal sponge 4 does not make a sliding contact with the inner circumferential surface of the cylindrical portion 26. As a result, the leakage of the toner through between the outer circumferential surface of the seal sponge 4 and the inner circumferential surface of the cylindrical portion 26 can be prevented.

In the above description, the cylindrical portion 26 and the seal sponge 4 have been described as being provided on the side wall 23 (i.e., the partition wall) between the toner storing chamber 20 and the waste toner storing chamber 25. However, the cylindrical portion 26 and the seal sponge 4 can be provided on other portion, for example, a wall portion that defines an end of the outer cartridge 21 in the longitudinal direction.

Second Embodiment

Figure 6:
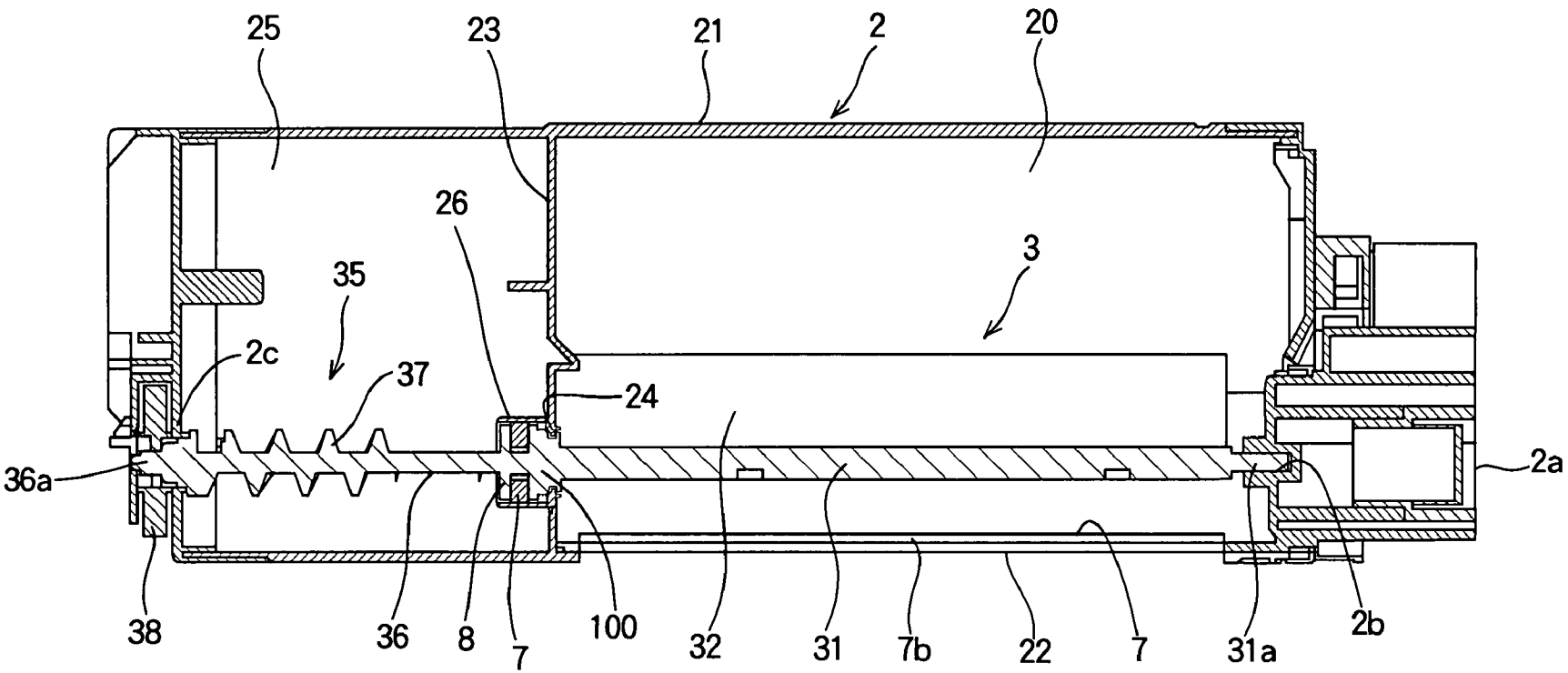
FIG. 6 is a sectional view of a toner cartridge according to the second embodiment of the present invention.

FIG. 6 is a sectional view showing a toner cartridge (i.e., a developer storing container) according to the second embodiment of the present invention. In FIG. 6, components that are the same as those of the first embodiment are assigned the same reference numerals.

In the second embodiment, a collar portion 8 (i.e., a side-contact portion) is provided on the shaft portion 36 of the agitating bar 3 so that the seal sponge 4 is disposed between the larger-diameter portion 100 and the collar portion 8 in the axial direction. The collar portion 8 has an annular shape and is provided coaxially with (more preferably, formed integrally with) the shaft portion 36 of the agitating bar 3. The collar portion 8 has an outer diameter which is larger than the inner diameter of the seal sponge 4, and is smaller than the inner diameter of the cylindrical portion 26. Further, the third portion 103 (i.e., a portion on the seal sponge 4 side) of the larger-diameter portion 100 has a larger diameter than the inner diameter D1 of the seal sponge 4 (and also larger than the outer diameter of the shaft portion 36), and is smaller than the outer diameter of the seal sponge 4.

Figure 7A:
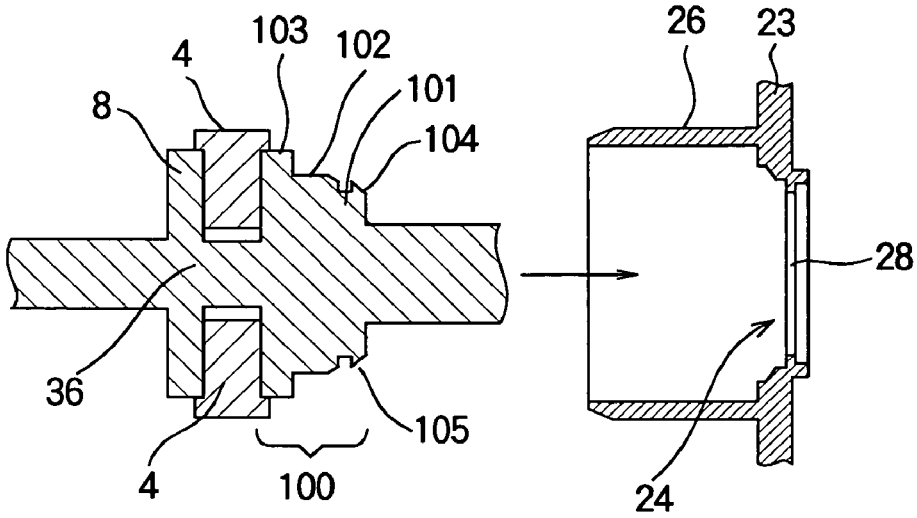
FIG. 7A is an enlarged view showing an agitating bar and a side wall before assembling of the toner cartridge according to the second embodiment of the present invention.
Figure 7B:
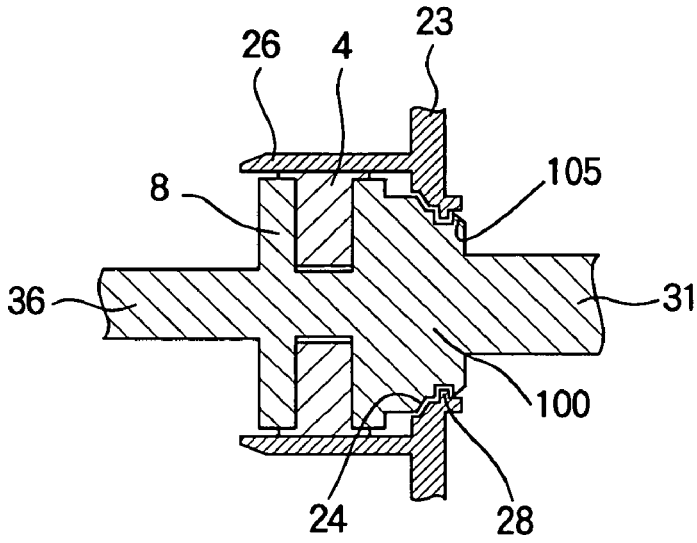
FIG. 7B is an enlarged view showing the agitating bar and the side wall after the assembling of the toner cartridge according to the second embodiment of the present invention.

FIGS. 7A and 7B are enlarged views showing the relationship between the agitating bar 3 and the side wall respectively before and after the assembling of the toner cartridge 2.

The seal sponge 4 is attached to the shaft portion 36 of the agitating bar 3 so as to be sandwiched by the collar portion 8 and the larger-diameter portion 100 from both sides. The thickness of the seal sponge 4 before the seal sponge 4 is attached to the agitating bar 3 (i.e., between the collar portion 8 and the larger-diameter portion 100) is set to be thicker than a gap between the collar portion 8 and the larger-diameter portion 100. Therefore, when the seal sponge 4 is attached to the shaft portion 36, the seal sponge 4 is compressed, and both side surfaces of the seal sponge 4 are pressed against the collar portion 8 and the larger-diameter portion 100. Before the seal sponge 4 is attached to the agitating bar 3, the outer diameter of the seal sponge 4 is larger than the inner diameter of the cylindrical portion 26 (as in the first embodiment), and the inner diameter of the seal sponge 4 is larger than the outer diameter of the shaft portion 36 and also larger than the inner diameter of the seal sponge 4 of the first embodiment.

As was described in the first embodiment, when the larger-diameter portion 100 is inserted into the shaft-receiving portion 24 of the side wall 23, the claw portion 105 moves beyond the convex portion 28 annularly formed on (and protruding from) the inner surface of the shaft-receiving portion 24, and engages the right side of the shaft-receiving portion 24 in FIG. 7B (i.e., the toner storing chamber 20 side). Therefore, the larger-diameter portion 100 and the shaft-receiving portion 24 engage each other, and the agitating bar 3 is rotatably supported by the shaft-receiving portion 24.

In this state, the seal sponge 4 is also inserted into the cylindrical portion 26. By the insertion of the seal sponge 4, the outer circumferential surface of the seal sponge 4 is pressed against the inner circumferential surface of the cylindrical portion 26, so as to seal between the seal sponge 4 and the cylindrical portion 26. Unlike the first embodiment, a gap is formed between the seal sponge 4 and the shaft portion 36.

With the above configured toner cartridge 2, even if the toner in the toner storing chamber 20 passes through between the shaft-receiving portion 24 and the larger-diameter portion 100 due to various kinds of vibration during transportation, a further movement of the toner is prevented since the outer circumferential surface of the seal sponge 4 is pressed against the inner circumferential surface of the cylindrical portion 26, and since both side surfaces of the seal sponge 4 are pressed against the collar portion 8 and the larger-diameter portion 100. Therefore, the leakage of the toner from the toner storing chamber 20 can be prevented.

Further, since there is a gap between the seal sponge 4 and the shaft portion 36 as described above, the seal sponge 4 does not rotate relative to the cylindrical portion 26, but the shaft portion 36 rotates relative to the seal sponge 4 when the agitating bar 3 rotates in the printing operation for supplying the toner to the image drum unit 6. In other words, the seal sponge 4 does not follow the rotation of the shaft portion 36. Thus, the outer circumferential surface of the seal sponge 4 does not make a sliding contact with the inner circumferential surface of the cylindrical portion 26. Therefore, it is further ensured that the leakage of the toner through between the outer circumferential surface of the seal sponge 4 and the inner circumferential surface of the cylindrical portion 26 is prevented.

Moreover, since the third portion 103 (i.e., a portion closest to the seal sponge 4) of the larger-diameter portion 100 has the outer diameter larger than the inner diameter D1 of the seal sponge 4, the third portion 103 prevents the toner from entering into the toner storing chamber 20 even if the toner moves toward the toner strong chamber 20 leaking through between the shaft portion 36 and the inner circumferential surface of the seal sponge 4.

Furthermore, the larger-diameter portion 100 has a shape with the outer diameter increasing in a direction toward the seal sponge 4. With such a shape, even if the toner may pass through between the shaft-receiving portion 24 and the larger-diameter portion 100, a further movement of the toner is prevented by a contact portion between the outer circumferential surface of the seal sponge 4 and the inner circumferential surface of the cylindrical portion 26 (i.e., a contact portion where the seal sponge 4 and the cylindrical portion 26 contact each other at a larger contact pressure). Therefore, it is further ensured that the leakage of the toner is prevented. Further, since the collar portion 8 has the outer diameter larger than the inner diameter D1 of the seal sponge 4, the collar portion 8 prevents the toner from entering into the waste toner storing chamber 25 even if the toner moves toward the waste toner strong chamber 25 leaking through between the shaft portion 36 and the inner circumferential surface of the seal sponge 4 for some reasons.

As described above, according to the second embodiment of the present invention, the outer circumferential surface of the seal sponge 4 contacts the inner circumferential surface of the cylindrical portion 26, and both side surfaces of the seal sponge 4 contact the collar portion 8 and the larger-diameter portion 100. Therefore, the movement of the toner is prevented at these contact portions, with the result that the leakage of the toner from the toner storing chamber 20 can be prevented.

Further, since the gap exists between the seal sponge 4 and the shaft portion 36, the seal sponge 4 does not rotate even when the shaft portion 36 rotates. Therefore, the outer circumferential surface of the seal sponge 4 does not make a sliding contact with the inner circumferential surface of the cylindrical portion 26. As a result, the leakage of the toner through the contact portion between the outer circumferential surface of the seal sponge 4 and the inner circumferential surface of the cylindrical portion 26 can be prevented.

In the second embodiment, it has been described that the gap exists between the seal sponge 4 and the shaft portion 36. However, it is also possible that the seal sponge 4 and the shaft portion 36 contact each other at a relatively small contact pressure (to an extent where the seal sponge 4 does not rotate relative to the cylindrical portion 26) as was described in the first embodiment.

Further, in the second embodiment, the cylindrical portion 26 and the seal sponge 4 have been described as being provided on the side wall 23 (i.e., the partition wall) between the toner storing chamber 20 and the waste toner storing chamber 25. However, the cylindrical portion 26 and the seal sponge 4 can be provided on other portion, for example, a wall portion that defines an end of the outer cartridge 21 in the longitudinal direction.

In the first and second embodiments, the cylindrical portion 26 has been described as an example of the hollow portion. However, it is also possible to use other hollow portion such as, for example, a hollow polygonal column or a hollow pyramid (with an apex being removed).

Further, in the first and second embodiments, a printer has been described as an example of an image forming apparatus. However, the present invention is also applicable to other image forming apparatus such as, for example, a copier, a facsimile machine, a MFP (Multiple-Function Peripheral) or the like.

While the preferred embodiments of the present invention have been illustrated in detail, it should be apparent that modifications and improvements may be made to the invention without departing from the spirit and scope of the invention as described in the following claims.

What is claimed is:

1. A developer storing container, comprising:

a developer storing chamber storing a developer therein and having a side wall, said side wall having a surrounding portion;

an agitating member having a shaft portion rotatably supported by said side wall, said shaft portion being surrounded by said surrounding portion, with an inner surface of said surrounding portion facing said shaft portion; and a seal member having an annular shape and being mounted between the inner surface of said surrounding portion and said shaft portion, said seal member having an outer circumferential surface contacting the inner surface of said surrounding portion and an inner circumferential surface contacting said shaft portion, wherein a contact pressure between said outer circumferential surface of said seal member and the inner surface of said surrounding portion is larger than a contact pressure between said inner circumferential surface of said seal member and said shaft portion of said agitating member.

2. The developer storing container according to claim 1, wherein said side wall has a shaft-receiving portion for rotatably supporting said shaft portion of said agitating member;

wherein said shaft portion of said agitating member has a larger-diameter portion that engages said shaft-receiving portion, and wherein said larger-diameter portion is disposed inside said surrounding portion and is disposed between said seal member and said side wall in an axial direction of said shaft portion.

3. The developer storing container according to claim 2, wherein said larger-diameter portion of said agitating member has a shape with an outer diameter increasing in a direction from said side wall toward said seal member.

4. The developer storing container according to claim 2, wherein said developer storing chamber includes first and second storing chambers partitioned with said side wall, wherein said agitating member includes an agitating portion that agitates said developer in said first storing chamber, and a conveying portion that conveys said developer in said second storing chamber, said agitating portion and said conveying portion being coaxial with each other with said larger-diameter portion disposed therebetween.

5. The developer storing container according to claim 2, wherein said larger-diameter portion has an outer diameter on a seal member side which is larger than an inner diameter of said seal member.

6. A developing device comprising said developer storing container according to claim 1.

7. An image forming apparatus comprising said developing device according to claim 6.

8. A developer storing container, comprising:

a developer storing chamber storing a developer therein and having a side wall, said side wall having a surrounding portion;

an agitating member having a shaft portion rotatably supported by said side wall, said shaft portion being surrounded by said surrounding portion, with an inner surface of said surrounding portion facing said shaft portion; and a seal member having an annular shape and being mounted between the inner surface of said surrounding portion and said shaft portion, wherein said agitating member has a side-contact portion disposed adjacent to said seal member, said side-contact portion having an outer diameter which is larger than an inner diameter of said seal member, and wherein said seal member has an outer circumferential surface contacting the inner surface of said surrounding portion of said side wall, and has a side surface contacting said side-contact portion of said agitating member.

9. The developer storing container according to claim 8, wherein a gap is formed between an inner circumferential surface of said seal member and said shaft portion of said agitating member.

10. The developer storing container according to claim 8, wherein said side wall has a shaft-receiving portion for rotatably supporting said shaft portion of said agitating member;

wherein said shaft portion of said agitating member has a larger-diameter portion that engages said shaft-receiving portion, and wherein said larger-diameter portion is disposed inside said surrounding portion and is disposed between said seal member and said side wall in an axial direction of said shaft portion.

11. The developer storing container according to claim 10, wherein said larger-diameter portion of said agitating member has a shape with an outer diameter increasing in a direction from said side wall to said seal member.

12. The developer storing container according to claim 10, wherein said developer storing chamber includes first and second storing chambers partitioned with said side wall, wherein said agitating member includes an agitating portion that agitates said developer in said first storing chamber, and a conveying portion that conveys said developer in said second storing chamber, said agitating portion and said conveying portion being coaxial with each other with said larger-diameter portion disposed therebetween.

13. The developer storing container according to claim 10, wherein said larger-diameter portion has an outer diameter on a seal member side which is larger than an inner diameter of said seal member.

14. A developing device comprising said developer storing container according to claim 8.

15. An image forming apparatus comprising said developing device according to claim 14.

16. The developer storing container according to claim 4, wherein said seal member is disposed between said agitating portion and said larger-diameter portion, and is restricted from moving in the axial direction of said shaft portion.

17. The developer storing container according to claim 10, wherein said seal member is disposed between said side-contact portion and said larger-diameter portion, and is restricted from moving in the axial direction of said shaft portion.

18. The developer storing container according to claim 1, wherein, even when said agitating member rotates, a rotation of said seal member is restricted by a contact pressure between said outer circumferential surface of said seal member and said inner surface of said surrounding portion.

19. The developer storing container according to claim 8, wherein, even when said agitating member rotates, a rotation of said seal member is restricted by a contact pressure between said outer circumferential surface of said seal member and said inner surface of said surrounding portion.

* * * * *